US008482221B2

(12) United States Patent
Sulaiman et al.

(10) Patent No.: US 8,482,221 B2
(45) Date of Patent: Jul. 9, 2013

(54) DEVICE DRIVER PROVIDING COMPENSATION FOR AGING

(71) Applicant: Light-Based Technologies Incorporated, Vancouver (CA)

(72) Inventors: Yohann Sulaiman, Vancouver (CA); Milen Moussakov, New Westminster (CA); Jeanette Jackson, Coquitlam (CA)

(73) Assignee: Light-Based Technologies Incorporated, Vancouver (CA)

( * ) Notice: Subject to any disclaimer, the term of this patent is extended or adjusted under 35 U.S.C. 154(b) by 0 days.

(21) Appl. No.: 13/683,159

(22) Filed: Nov. 21, 2012

(65) Prior Publication Data

US 2013/0113395 A1 May 9, 2013

Related U.S. Application Data

(63) Continuation of application No. 12/729,148, filed on Mar. 22, 2010, now Pat. No. 8,350,495.

(60) Provisional application No. 61/184,744, filed on Jun. 5, 2009.

(51) Int. Cl.
*G05F 1/00* (2006.01)

(52) U.S. Cl.
USPC ..... 315/291; 315/294; 315/224; 315/158; 345/82; 345/212

(58) Field of Classification Search
USPC ..... 315/169.1–169.3, 224, 149, 154, 315/158, 291, 294, 295, 307, 308, 312; 345/76, 345/81, 82, 102, 204, 212, 213
See application file for complete search history.

(56) References Cited

U.S. PATENT DOCUMENTS

| | | | | |
|---|---|---|---|---|
| 4,791,632 | A | 12/1988 | Anderson et al. | |
| 5,859,658 | A | 1/1999 | Hammond | |
| 6,353,291 | B1 | 3/2002 | Borgogno et al. | |
| 6,414,661 | B1 | 7/2002 | Shen et al. | |
| 6,456,016 | B1 | 9/2002 | Sundahl et al. | |
| 6,504,565 | B1 | 1/2003 | Narita et al. | |
| 6,541,921 | B1 | 4/2003 | Luciano et al. | |
| 6,947,456 | B2 | 9/2005 | Chin et al. | |
| 6,995,519 | B2 | 2/2006 | Arnold et al. | |
| 7,161,566 | B2 | 1/2007 | Cok et al. | |
| 7,321,348 | B2 | 1/2008 | Cok et al. | |
| 7,391,172 | B2 * | 6/2008 | Ferguson et al. | 315/308 |
| 8,350,495 | B2 * | 1/2013 | Sulaiman et al. | 315/291 |

(Continued)

FOREIGN PATENT DOCUMENTS

| | | | |
|---|---|---|---|
| JP | 2002278514 | A2 | 9/2009 |
| WO | 0215288 | A1 | 2/2002 |

*Primary Examiner* — Haiss Philogene
(74) *Attorney, Agent, or Firm* — Oyen Wiggs Green & Mutala LLP

(57) ABSTRACT

Driving circuits are provided that compensate for devices having characteristics that change with age. A correction circuit has a reference device having an output that changes with age in a known manner over a time span similar to the expected lifetime of the driven device. The output of reference device provides an indication of the current age of driven device.

22 Claims, 17 Drawing Sheets

U.S. PATENT DOCUMENTS

| | | | |
|---|---|---|---|
| 2002/0167474 | A1 | 11/2002 | Everitt |
| 2003/0118063 | A1 | 6/2003 | Sugawara |
| 2005/0110728 | A1 | 5/2005 | Cok |
| 2008/0048951 | A1 | 2/2008 | Naugler et al. |
| 2008/0128587 | A1 | 6/2008 | Lyu et al. |
| 2008/0224966 | A1 | 9/2008 | Cok et al. |
| 2008/0258637 | A1 | 10/2008 | Leung |
| 2010/0123649 | A1 | 5/2010 | Hamer et al. |

* cited by examiner

DEVICE DRIVER PROVIDING COMPENSATION FOR AGING

REFERENCE TO RELATED APPLICATIONS

This application is a continuation of U.S. application Ser. No. 12/729,148 filed 22 Mar. 2010, now U.S. Pat. No. 8,350,495, which claims priority from U.S. provisional patent application No. 61/184,744 filed 5 Jun. 2009 and entitled DEVICE DRIVER PROVIDING COMPENSATION FOR AGING, both of which are hereby incorporated by reference herein. For purposes of the United States of America, this application claims the benefit of U.S. provisional patent application No. 61/184,744 filed 5 Jun. 2009 and entitled DEVICE DRIVER PROVIDING COMPENSATION FOR AGING under 35 U.S.C. §119, which is hereby incorporated by reference herein.

TECHNICAL FIELD

The invention relates to driving devices having characteristics that change with age. Some embodiments have application, for example, in driving light-emitting diodes (LEDs) and other light sources.

BACKGROUND

Many electronic devices have characteristics that change with age. For example, the relationship between driving current and light output of light sources such as light-emitting diodes (LEDs); cold cathode fluorescent lamps (CCFLs) and others can change as the light source ages. There is a need for practical methods and apparatus for compensating for such changes to reduce the variation in device performance with time.

In the general case, devices such as LEDs do not degrade linearly with time. This complicates the task of compensating for device aging.

Some patents and patent applications that relate to the aging of devices include:

- US patent application publication Nos.: 2008/0258637; 2008/0224966; 2005/110728; 2002/0167474.
- PCT patent application publication No. WO 2002/015288;
- U.S. Pat. Nos. 7,161,566; 6,995,519; 6,504,565; 6,456,016; 6,414,661; 4,791,632; and
- Japanese patent application publication No. 2002/278514A.

SUMMARY OF THE INVENTION

One aspect of the invention provides an apparatus for controlling an output device having response characteristics which vary as the output device ages in response to an input signal from a driver circuit. The apparatus comprises a reference device having response characteristics which vary as the reference device ages, a monitoring circuit connected to measure an output of the reference device and produce a reference signal representative of the output of the reference device, and, an adjustment circuit connected to receive the input signal from the driver circuit and to receive the reference signal from the monitoring circuit. The adjustment circuit is configured to provide a driving signal to the output device. The driving signal comprises the input signal multiplied by a correction factor selected based on the reference signal and a relationship between the response characteristics of the output device and the response characteristics of the reference device.

Another aspect of the invention provides an apparatus for controlling an output device having response characteristics which vary as the output device ages in response to an input signal. The apparatus comprises a driver circuit connected to receive the input signal comprising a register for storing an aging compensation value, a reference device connected to be driven by a reference power supply, the reference device having response characteristics which vary as the reference device ages, a control circuit connected to receive the input signal, the control circuit configured to control the reference power supply to drive the reference device based on the input signal, a monitoring circuit connected to measure an output of the reference device and produce a reference signal representative of the output of the reference device, and, compensation logic connected to receive the reference signal from the monitoring circuit. The compensation logic is configured to derive the aging compensation value based on the reference signal and store the aging compensation value in the register. The driver circuit is configured to adjust the input signal based on the aging compensation value stored in the register to generate a corrected driving signal and provide the corrected driving signal to the output device.

Another aspect of the invention provides an apparatus for ensuring a substantially constant output from an output device having response characteristics which vary as the output device ages over a lifetime of the output device. The apparatus comprises a reference signal source which produces a reference signal having known aging characteristics, a subtraction circuit connected to the reference signal from the reference signal source and a constant voltage from a constant voltage source and configured to produce a difference signal by subtracting the reference signal from the constant voltage, a selection circuit connected to receive the difference signal from the subtraction circuit and comprising a plurality of outputs and configured to provide the difference signal to one of the plurality of outputs based on a voltage of the difference signal, a plurality of band amplification circuits, each band amplification circuit connected to one of the plurality of outputs of the selection circuit and configured to apply a gain to the difference signal based on a relationship between the aging characteristics of the reference signal and aging characteristics of the output device to produce a band output signal, and, a constant gain circuit connected to receive the band output signal from each of the plurality of band amplification circuits and apply a constant gain thereto to provide a driving signal to the output device.

Another aspect of the invention provides a method for controlling an output device having response characteristics which vary as the output device ages in response to an input signal from a driver circuit. The method comprises providing a reference device having response characteristics which vary as the reference device ages, receiving a reference signal representative of the output of the reference device, adjusting the input signal received from the driver circuit by multiplying the input signal by a correction factor selected based on the reference signal and a relationship between the response characteristics of the output device and the response characteristics of the reference device to generate an adjusted signal, and, driving the output device based on the adjusted signal.

Further aspects of the invention and features of specific embodiments of the invention are described below.

BRIEF DESCRIPTION OF THE DRAWINGS

In drawings which illustrate non-limiting embodiments of the invention.

DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Figure 1:
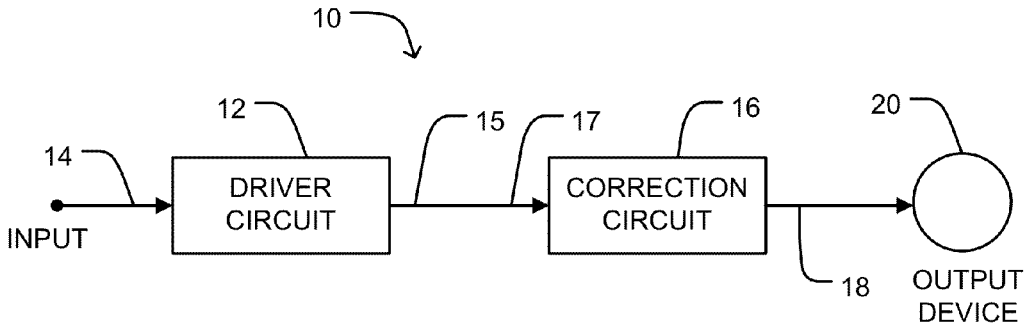
FIG. 1 is a block diagram of an electronic apparatus according to an embodiment of the invention.

FIG. 1 shows an electronic apparatus 10 according to an example embodiment. Apparatus 10 comprises a driver circuit 12 having an input 14 and an output 15. Driver circuit 12 is configured to receive a control signal at input 14 and to generate a corresponding output signal at its output 15. The input signal may be an analog or digital signal, for example. The output signal may comprise a direct current or alternating current analog voltage or current signal or a time-varying output signal such as a pulse-width modulated (PWM) signal.

A correction circuit 16 has an input 17 coupled to output 15 of driver circuit 12 and an output 18 coupled to drive an output device 20. In the following description, output device 20 comprises a light emitting diode however, it will be appreciated that output device 20 may comprise a light emitter of a different type or another type of device.

Correction circuit 16 generates a driving signal corresponding to the output signal presented at its input 17. The driving signal includes aging compensation, as described below.

Figure 2:
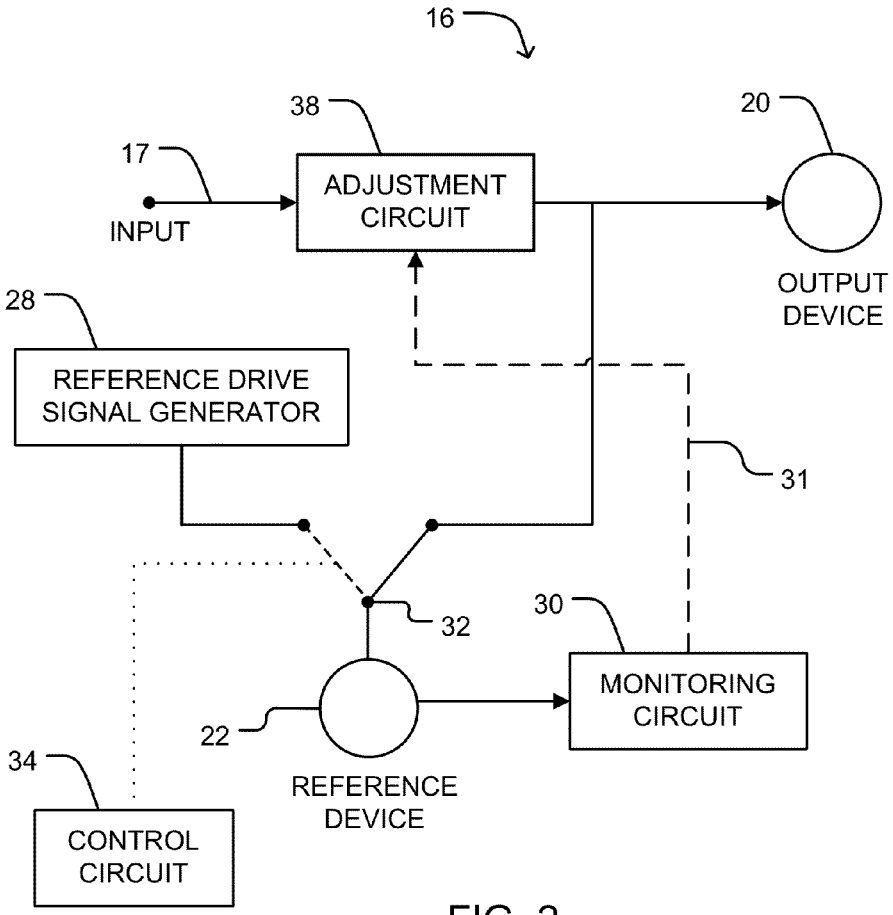
FIG. 2 is a block diagram of a correction circuit according to an embodiment of the invention.

As shown schematically in FIG. 2, correction circuit 16 comprises a reference device 22. Reference device 22 is an electrically driven device that has an output or other characteristic that changes with age in a known manner over a time span similar to the expected lifetime of output device 20. The output of reference device 22 thus provides an indication of the current effective age of output device 20.

In many cases the effective age of output device 20 depends upon the usage of output device 20 (as opposed to the amount of time that has elapsed since output device 20 was manufactured). In some embodiments, the same driving signal applied to drive output device 20 is applied to drive reference device 22. This makes reference device 22 age in step with the effective aging of output device 20.

In the embodiment illustrated in FIG. 2, correction circuit 16 comprises a reference drive signal generator 28 and a monitoring circuit 30 connected to measure an output of reference device 22. In the illustrated embodiment, a driving signal applied to output device 20 is also applied to reference device 22. Periodically or whenever it is desired to obtain a measure of the aging of reference device 22 (and corresponding effective aging of output device 20) device 22 is connected to be driven by reference drive signal generator 28 and the output of reference device 22 is monitored by monitoring circuit 30. In the illustrated embodiment, this measurement may be made by switching switch 32 from the 'aging' position indicated by a solid line to the 'measurement position' indicated by the dashed line. Switch 32 may be electronically controlled by a control circuit 34.

In other embodiments, reference device may not be driven by the same signal applied to output device 20. In such embodiments, switch 32 is not required and reference device 22 may be driven by reference drive signal generator 28 whenever output device 20 is 'on' (and not driven otherwise). These other embodiments have the advantage of simplicity and can be acceptable particularly where the duty cycle or signal strength of output device 20 can be assumed to have some average value.

The output of reference device 22, as detected by monitoring circuit 30 is applied to control an adjustment circuit 38. Circuit 38 modifies the output signal presented at input 17 to yield the driving signal applied to output device 20. Circuit 38 may, for example, amplify and/or adjust an offset of the signal presented at input 17. In some embodiments circuit 38 comprises a voltage controlled amplifier having a gain controlled by the output of reference device 22, as detected by monitoring circuit 30.

Figure 3:
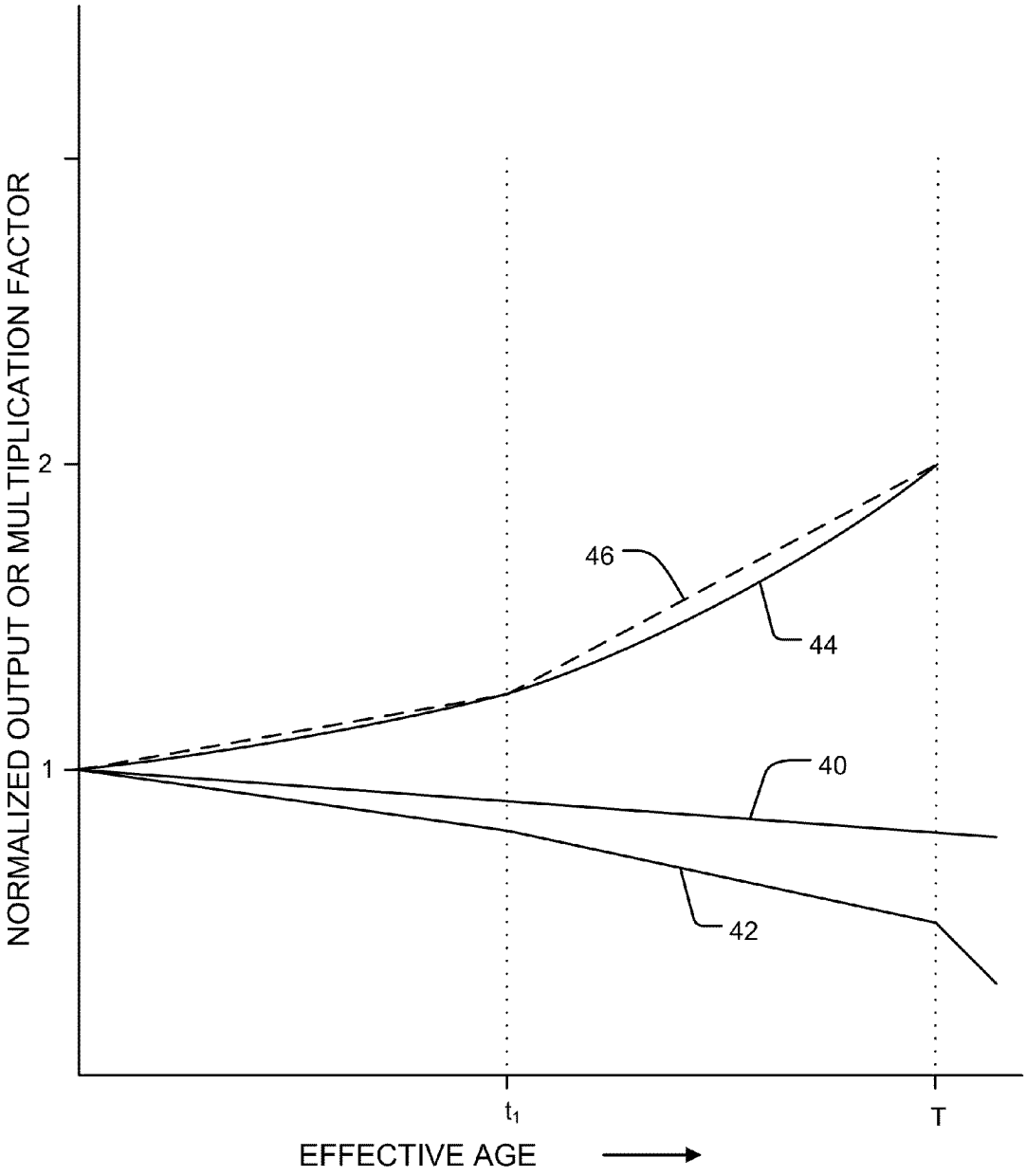
FIG. 3 illustrates variations in electrical signals over time for an electronic apparatus according to an embodiment of the invention.

Consider the simple example case illustrated by the graphs of FIG. 3. Curve 40 shows the normalized output Z(t) of monitoring circuit 30 as a function of age for some standard reference drive signal. Curve 42 shows the variation in output X(t) of output device 20 for some standard driving signal s over the same effective age range $0<t<T$ where t is the age of device 20 and T is its expected lifetime. X(t) may, for example, be light output where device 20 is an LED. X(t) is generally known in advance. X(t) may, for example, comprise a decay curve specified by a manufacturer of device 20.

It can be seen that the output of output device 20 (under the standard conditions) would remain constant as output device 20 ages if the output were multiplied by a factor A(t) as follows:

$$\text{Corrected Output}=A(t)\times\text{Uncorrected Output} \quad (1)$$

where A is given by $A(t)=X(0)/X(t)$ (and X(0) is the value of X(t) at time t=0). In cases where the output of output device 20 has a linear relationship to the driving signal for output device 20 this result can be achieved by multiplying the driving signal by A(t). In cases where the output of output device 20 has a non-linear relationship to the driving signal d for output device 20 given by F(d) then the same result can be achieved by providing a driving signal given by $F^{-1}(A(t)F(s))$ where $F^{-1}(\ )$ is the inverse of F and s is the standard driving signal.

Curve 44 plots the multiplication factor A(t) as a function of age. Dotted line 46 illustrates a linear approximation of curve 44 comprising of two linear segments. In the case where both A(t) and Z(t) are linear with t or can be approximated to a desired degree of accuracy as being linear in t then A(t) can be given by:

$$A(t)=mZ(t)+b \tag{2}$$

where m and b are constants.

Figure 4:
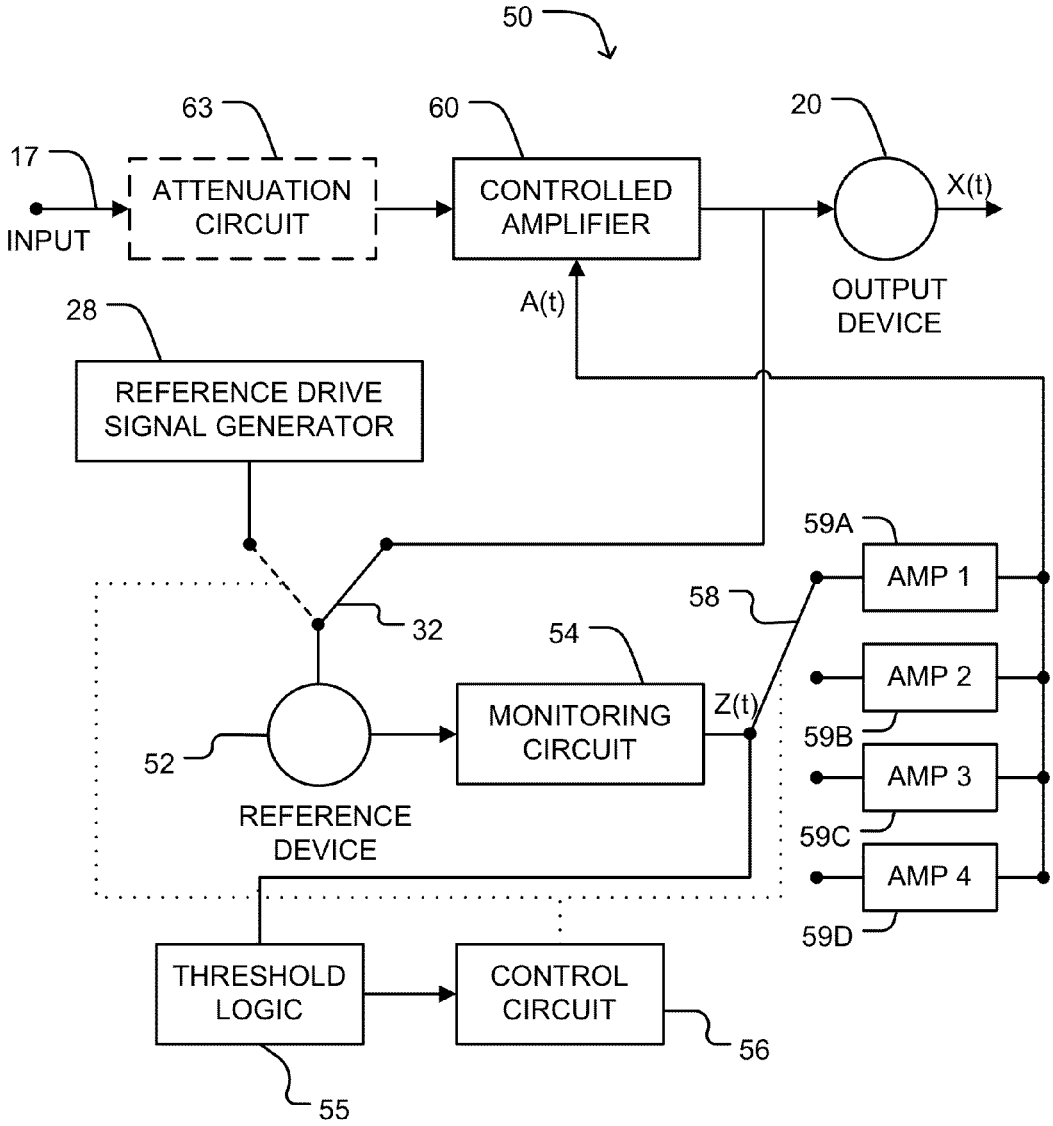
FIG. 4 is a block diagram of a correction circuit according to an alternative embodiment of the invention.

Some embodiments exploit the fact that in many applications the relationship between A(t) and Z(t) is at least approximately linear or piecewise linear with t. FIG. 4 shows an example correction circuit 50 that exploits this property. Circuit 50 comprises a reference device 52 and a monitoring circuit 54 that monitors an output of reference device 52 to yield an output signal Z(t). A control circuit 56 controls an analog switch 58 that connects Z(t) to one of a plurality of amplifier circuits 59 (individually shown as 59A to 59D). Control circuit 56 may also control switch 32 as described above.

Each amplifier circuit 59 corresponds to a range of time over which the relationship between A(t) and Z(t) is linear to some desired level of accuracy. In the illustrated embodiment, the relationship between A(t) and Z(t) is represented by four such segments but there may be more or fewer linear segments in other embodiments.

Threshold logic 55 receives Z(t), and may compare the current value of Z(t) to a number of thresholds. For example: threshold logic 55 may be configured to cause control circuit 56 to select: amplifier circuit 59A when Z is within a first range or "band" wherein $Z \geqq Z_1$; amplifier circuit 59B when Z is within a second band wherein $Z_1 > Z \geqq Z_2$; amplifier circuit 59C when Z is within a third band wherein $Z_2 > Z \geqq Z_3$; and amplifier circuit 59D when Z is within a fourth band wherein $Z_3 > Z$.

Each of amplifier circuits 59 has a gain selected to match the slope m of A(t)=mZ(t)+b in the current segment such that when Z(t) is supplied as an input to the circuit then the output of the amplifier circuit 59 is proportional to A. Each of amplifier circuits 59 also adds offset b.

The output of the currently active amplifier circuit 59 is supplied to a controlled amplifier 60 that amplifies the output signal from a driving circuit 12 to yield a corrected driving signal. The corrected driving signal drives an output device 20.

Figure 3A:
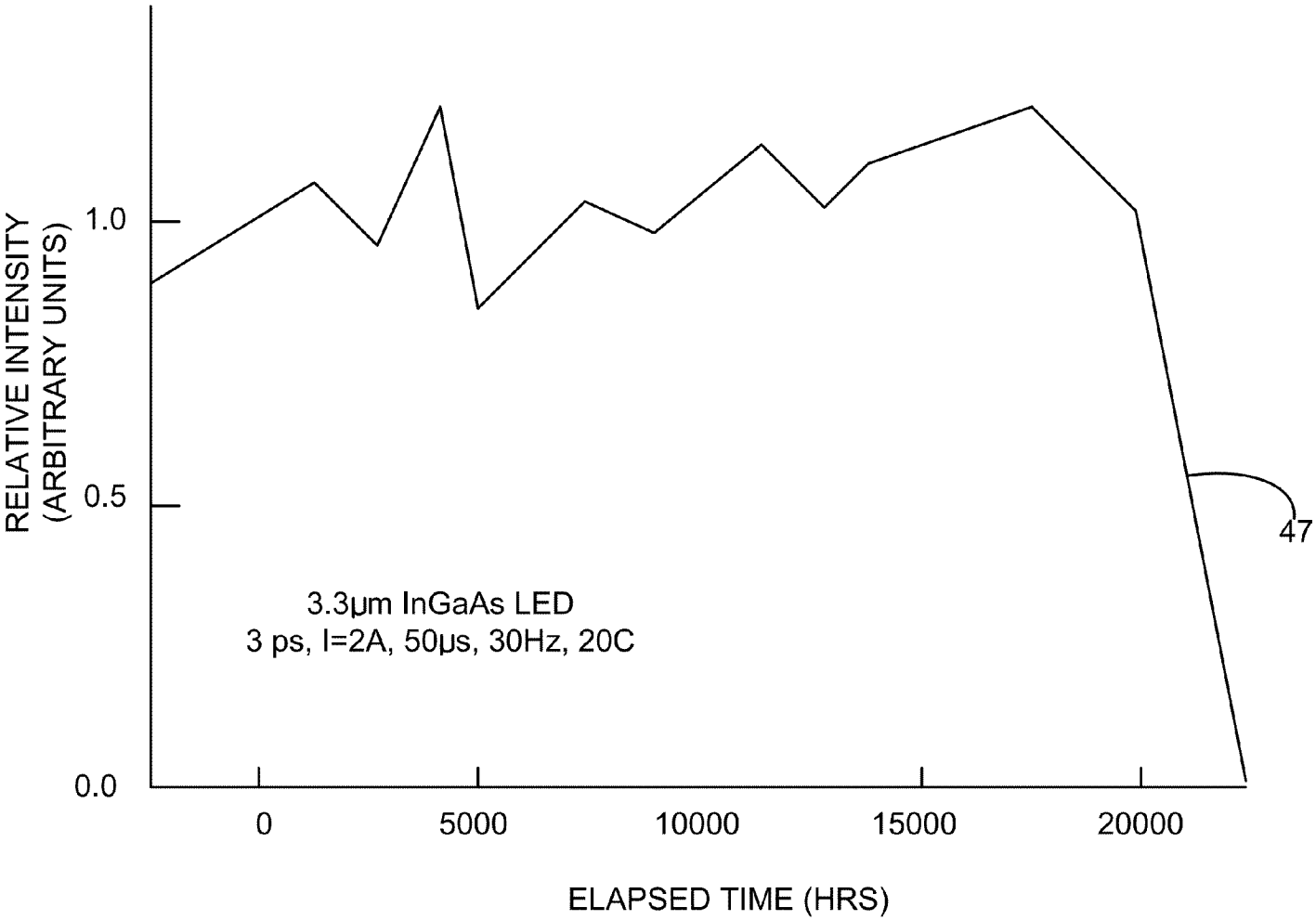
FIG. 3A is an illustrative plot showing example variation in relative intensity as a function of elapsed time for a LED.

Some types of devices have responses which rise and fall over time in response to some standard driving signal. For example, FIG. 3A shows a graph of a decay curve 47 for an example InGaAs LED. Circuits similar to circuit 50 may be used in conjunction with such devices by selecting a plurality of ranges or "bands" 48A-E for the responses of the device, and assigning an amplifier circuit 59 to each band. The Amplifier circuits 59 may be selected based on known characteristics of curve 47 within each band to provide an approximation of A(t) which minimizes errors over the useful lifetime of the device.

Some advantages that correction circuits as described above may have are:

- Such circuits can be made to operate to compensate for the aging of a device without collecting feedback from the device itself. For example, where such a correction circuit drives an LED to emit light it is not necessary to provide a light sensor to monitor the light output by the LED.
- Such circuits may operate independently of the driving circuit 12 that generates the signal to drive an output device 20. It is possible to apply such correction circuits without redesigning or altering the driving circuit 12.
- Such circuits may be configured to compensate for aging of components in driving circuit 12 as well as for the effects of aging on a driven device 20.

There are a wide range of variations possible in the practice of this invention. For example, while the reference device may be a device of the same type as the driven device 20 this is not mandatory. The reference device may comprise a semiconductor junction. In some embodiments, the reference device comprises a component on a large-scale integration (LSI) chip that also comprises the correction circuit. In a specific example embodiment the reference device comprises a p-n semiconductor junction and the monitored characteristic of the reference device may be a voltage drop across the reference device. The p-n junction may comprise a number of quantum wells.

The characteristic of the reference device that is monitored to obtain a signal Z indicative of the aging of the reference device (and the driven device) may comprise a light output, a voltage drop, a current, or the like. All that is required is that the measured characteristic change as the reference device ages and that the measured characteristic be measurable with sufficient accuracy to provide the desired compensation.

Where the performance of a device deteriorates with age, the maximum output of the device may decrease as time passes. If it is desired to make the device perform in substantially the same manner throughout its lifetime then it may be necessary initially to attenuate the driving signal to the device so that the maximum output of the device initially (when the device is unaged) will be the same as the maximum output of the device at the end of its expected life span.

Consider the example case where the device is a LED. The LED may, when new, provide a light output of 100 (in some arbitrary units) when driven at its rated current. At the end of its expected life span, the LED performance may have deteriorated to the point that the light output at the rated current is some smaller value (e.g. only 50 units). While it may be possible to achieve a greater light output by over-driving the LED (applying a current greater than the rated current) this tends to reduce the LED's life span. In a case where the LED will be caused to perform in the same way throughout its life span, the driving current for the LED may initially be attenuated to a level producing light output of 50 units. Correction, as described above, may be applied to maintain the possibility of a maximum light output of 50 units throughout the life span of the LED. This attenuation may be provided by a separate attenuation circuit 63, such as is shown in a dotted line in FIG. 4, that attenuates the driving signal before the driving signal is amplified by controlled amplifier 60. Alternatively, attenuation may be provided by controlled amplifier 60 in an embodiment like that shown in FIG. 4 in which dotted attenuation circuit 63 is not present and input 17 connects directly to controlled amplifier 60.

Figure 5:
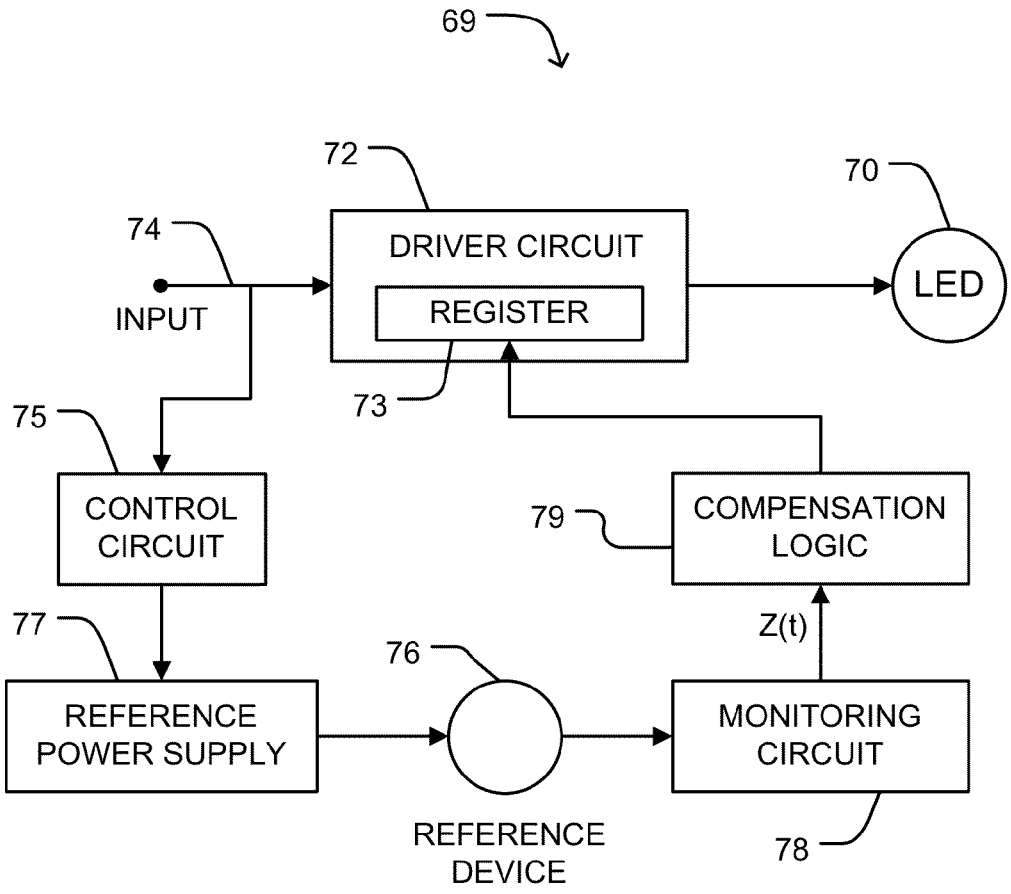
FIG. 5 is a block diagram of an LED driver according to an alternative embodiment of the invention.

It is possible to use features of an existing device driving circuit to provide compensation for device aging. For example, some LED driver circuits include a register that stores a compensation value and circuits that adjust the response of the driver circuit to an input signal according to the compensation value. FIG. 5 shows an alternative embodiment of a LED driver 69 wherein a LED 70 is driven by a LED driver circuit 72 in response to an input signal 74. Driver circuit 72 includes a register 73 that stores an aging compensation value.

A reference power supply 77 is controlled by a control circuit 75 to drive a reference device 76 when LED 70 is being driven. Control circuit 75 may drive reference device 76 based on input signal 74. A monitoring circuit 78 monitors a characteristic of reference device 76. Compensation logic 79 receives the output Z(t) of monitoring circuit 78, derives an aging compensation value for LED 70 based upon the value of Z(t) and stores the aging compensation value in register 73.

There is a wide range of possible variations in LED driver 69. Some examples are:

- Instead of a register 73, LED driver circuit 72 may comprise an input that can receive a voltage or current signal and circuitry that provides aging compensation in an amount controlled by the voltage or current signal. In the further alternative, LED driver circuit 72 may comprise an input that can monitor the value of an external component such as a resistor or capacitor set by compensation logic 79.
- LED 70 may be replaced by another type of light-emitting device or some other type of device having an output that varies as the device ages.
- Compensation logic 79 may receive Z(t) in the form of analog or digital data.
- Compensation logic 79 may comprise a data processor that implements an algorithm for computing the aging compensation value from Z(t); a lookup table; or the like.
- Compensation logic 79 may operate continuously or only periodically at regular or irregular intervals.

Figure 6:
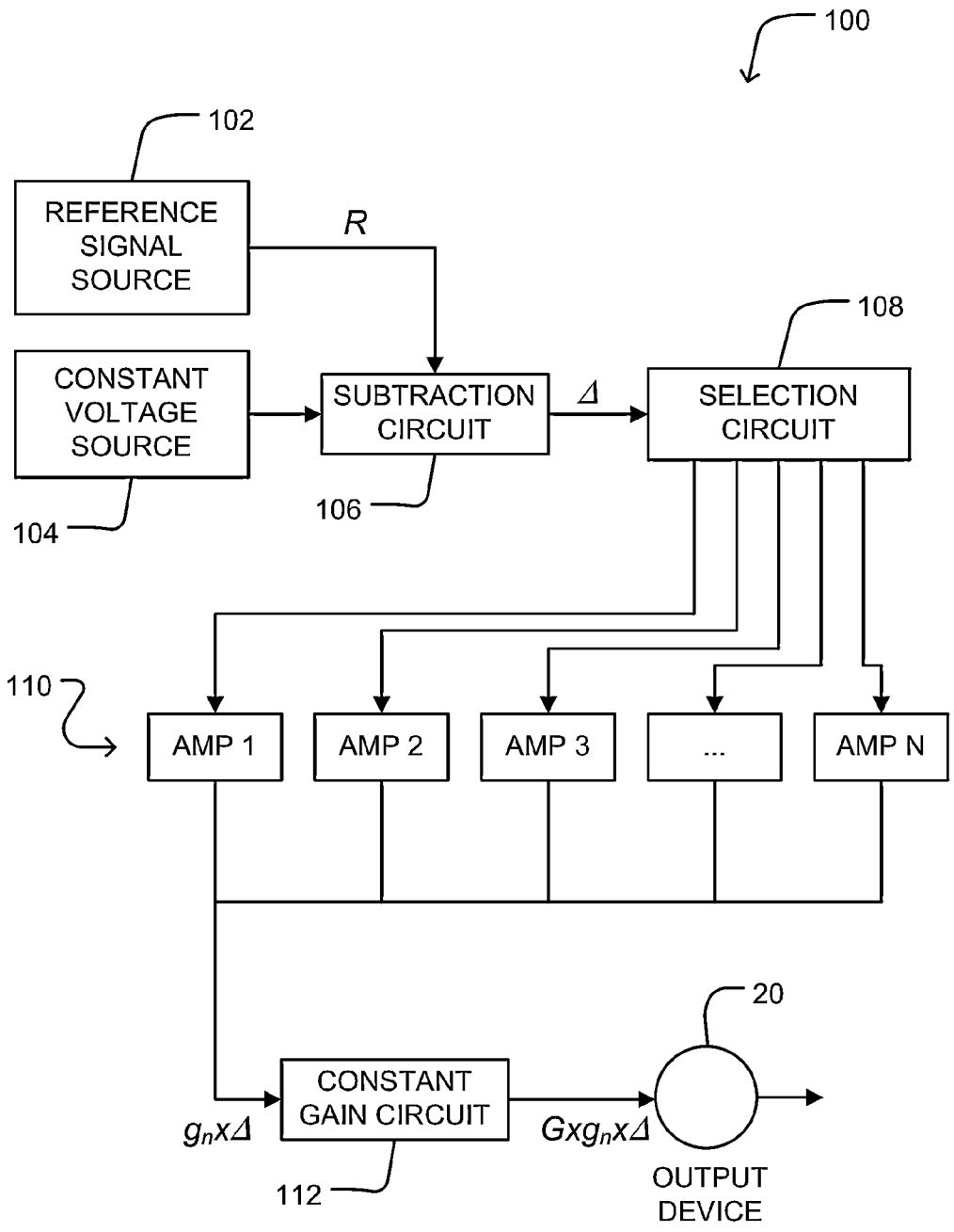
FIG. 6 is a block diagram of a correction apparatus according to an alternative embodiment of the invention.

FIG. 6 shows an electronic apparatus 100 according to another example embodiment. Apparatus 100 is configured to drive output device 20 to produce substantially constant output over the useful lifetime of output device 20 by compensating for aging characteristics of output device 20.

Apparatus 100 comprises a reference signal source 102, which may comprise a reference device having an output which varies with time in a known way, as described above. Apparatus 100 also comprises constant voltage source 104, which provides a constant voltage to a subtraction circuit 106. Reference signal source 102 produces a reference signal R with known aging characteristics, which is also provided to subtraction circuit 106.

Figure 7:
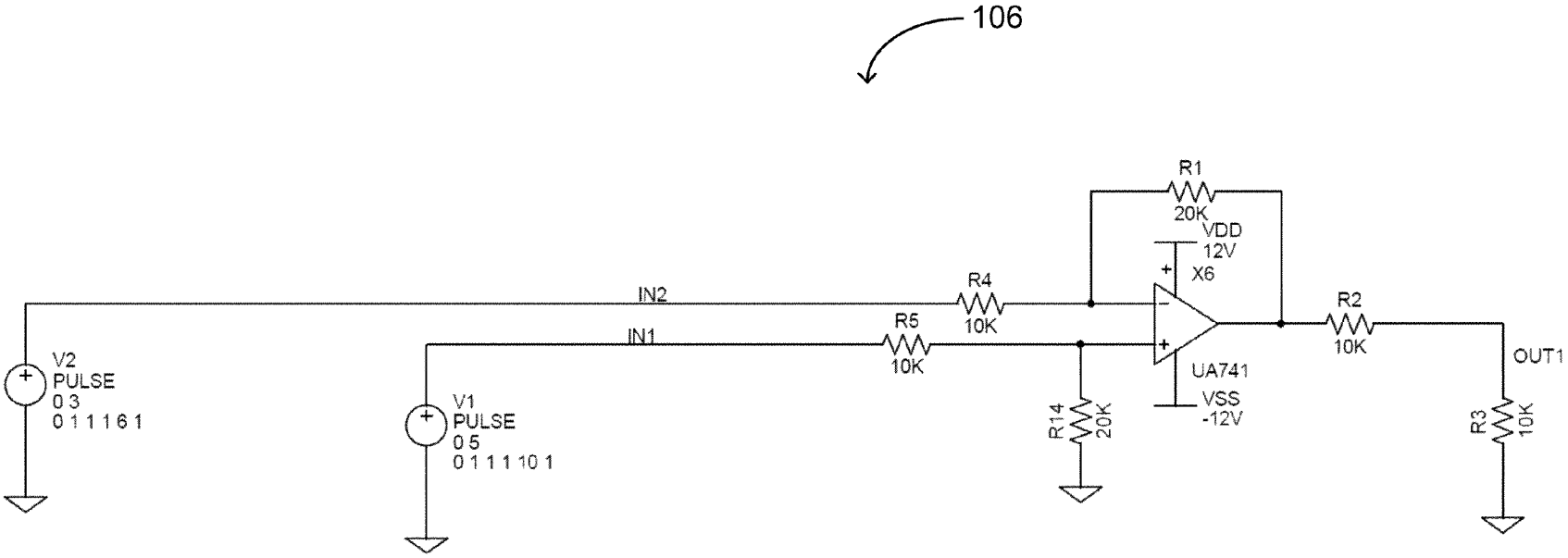
FIG. 7 schematically illustrates an example subtraction circuit of the correction apparatus of FIG. 6.

Subtraction circuit 106 subtracts reference signal R from the constant voltage to produce a difference signal Δ. FIG. 7 shows an example subtraction circuit 106, which comprises a differential amplifier and a voltage divider. In the FIG. 7 example, the constant voltage is applied to IN1, reference signal R is applied to IN2, and difference signal Δ is produced at OUT1.

Subtraction circuit 106 provides difference signal Δ to a selection circuit 108. Selection circuit 108 selectively provides difference signal Δ to one of a plurality of band amplification circuits 110 based on the voltage of difference signal Δ. For example, difference signal Δ may be provided to a first band amplification circuit 110 when the voltage of difference signal Δ is within a first range, to a second first band amplification circuit 110 when the voltage of difference signal Δ is within a second range, and so on.

Figure 8:
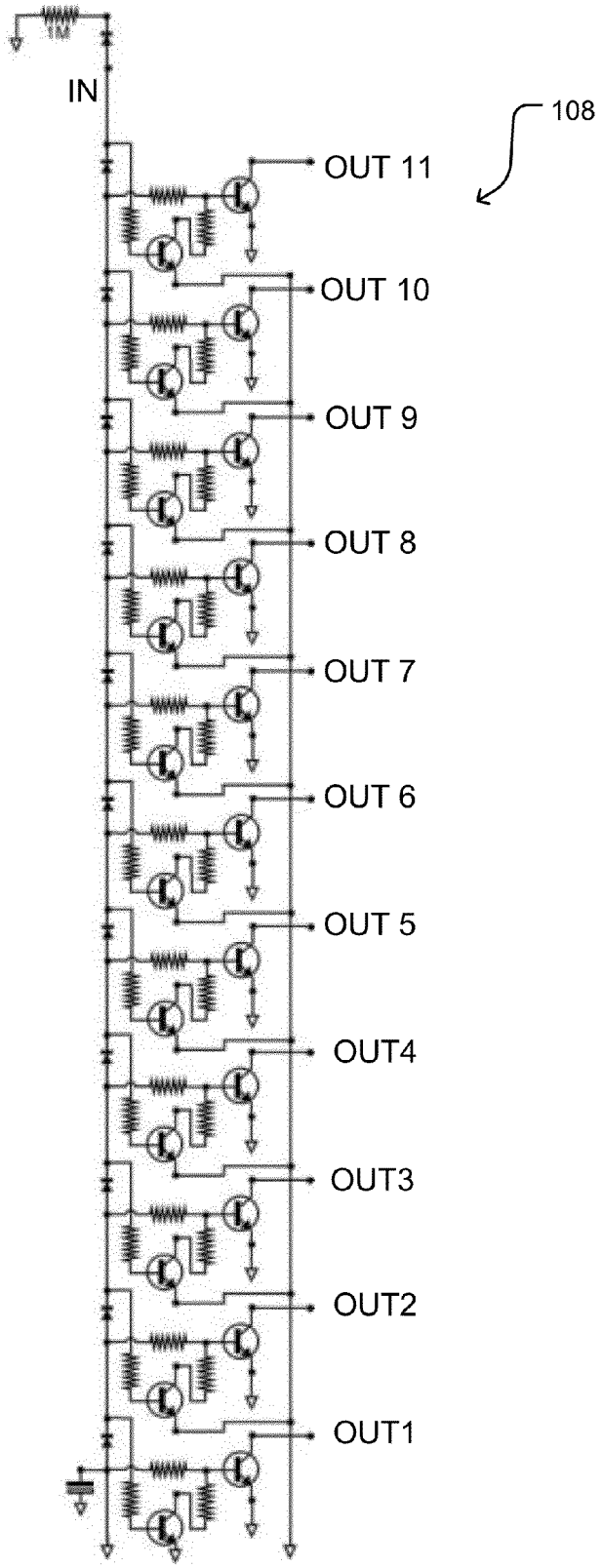
FIG. 8 schematically illustrates an example selection circuit of the correction apparatus of FIG. 6.

FIG. 8 shows an example selection circuit 108, which comprises an analog ladder. In the FIG. 8 example, difference signal Δ is applied to IN and passed to one of OUT1-OUT11, depending on the voltage of difference signal Δ. Each of OUT1-OUT11 may be connected to a different band amplification circuit 110. Although eleven outputs are shown in the FIG. 8 example, it is to be understood that selection circuit 108 may have any number of outputs.

Each band amplification circuit 110 is associated with a predetermined voltage range or "band" of difference signal Δ. Each band amplification circuit 110 may be selected based on the relationship between the aging characteristics of reference signal source 102 and output device 20 to minimize deviations from a constant output for output device 20 over the entire band associated with that band amplification circuit 110. Each band amplification circuit 110 applies a gain $g_n$ to difference signal Δ.

Figure 9A:
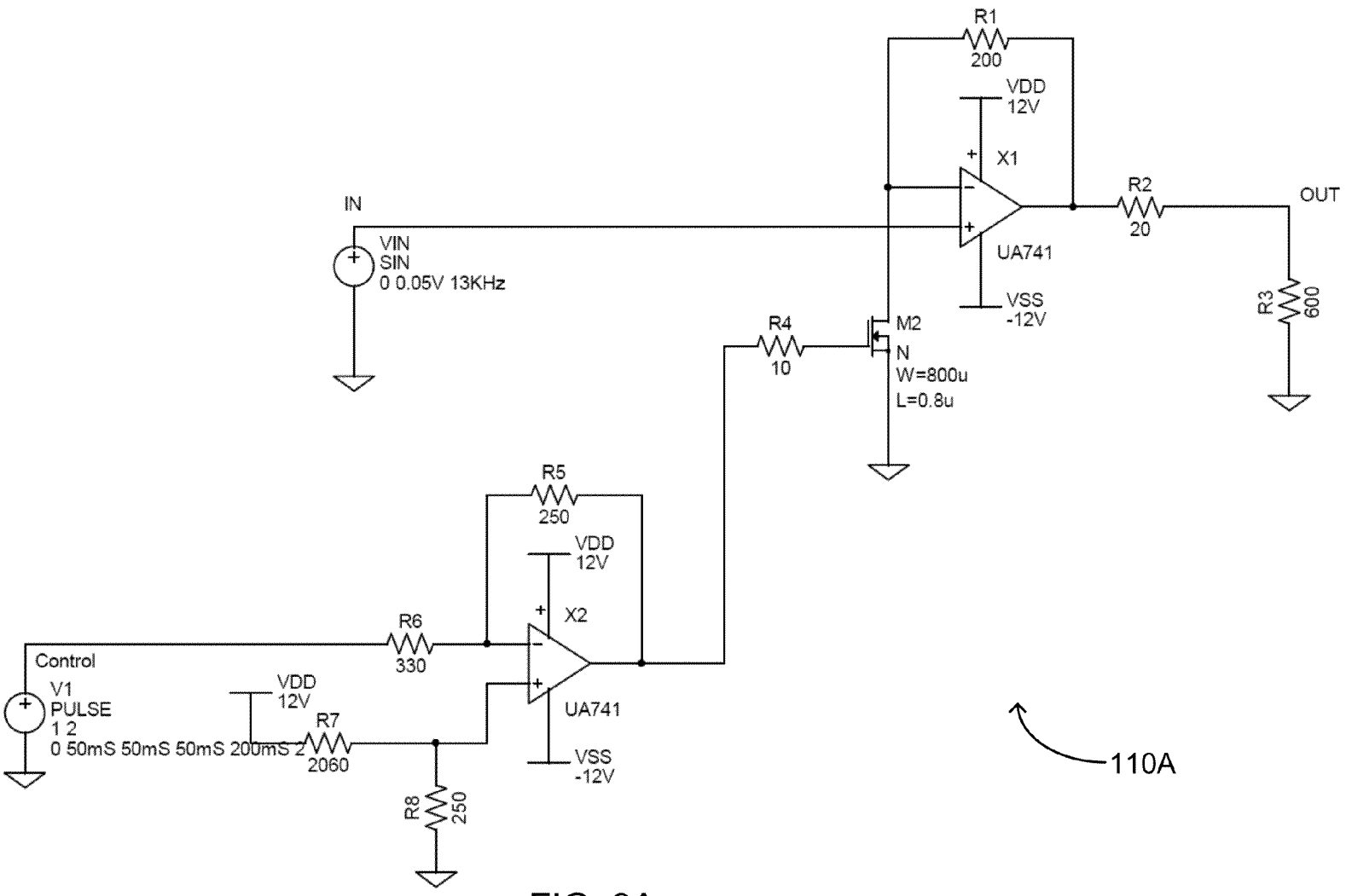
FIGS. 9A-9F schematically illustrate example banded amplification circuits of the correction apparatus of FIG. 6.
Figure 9B:
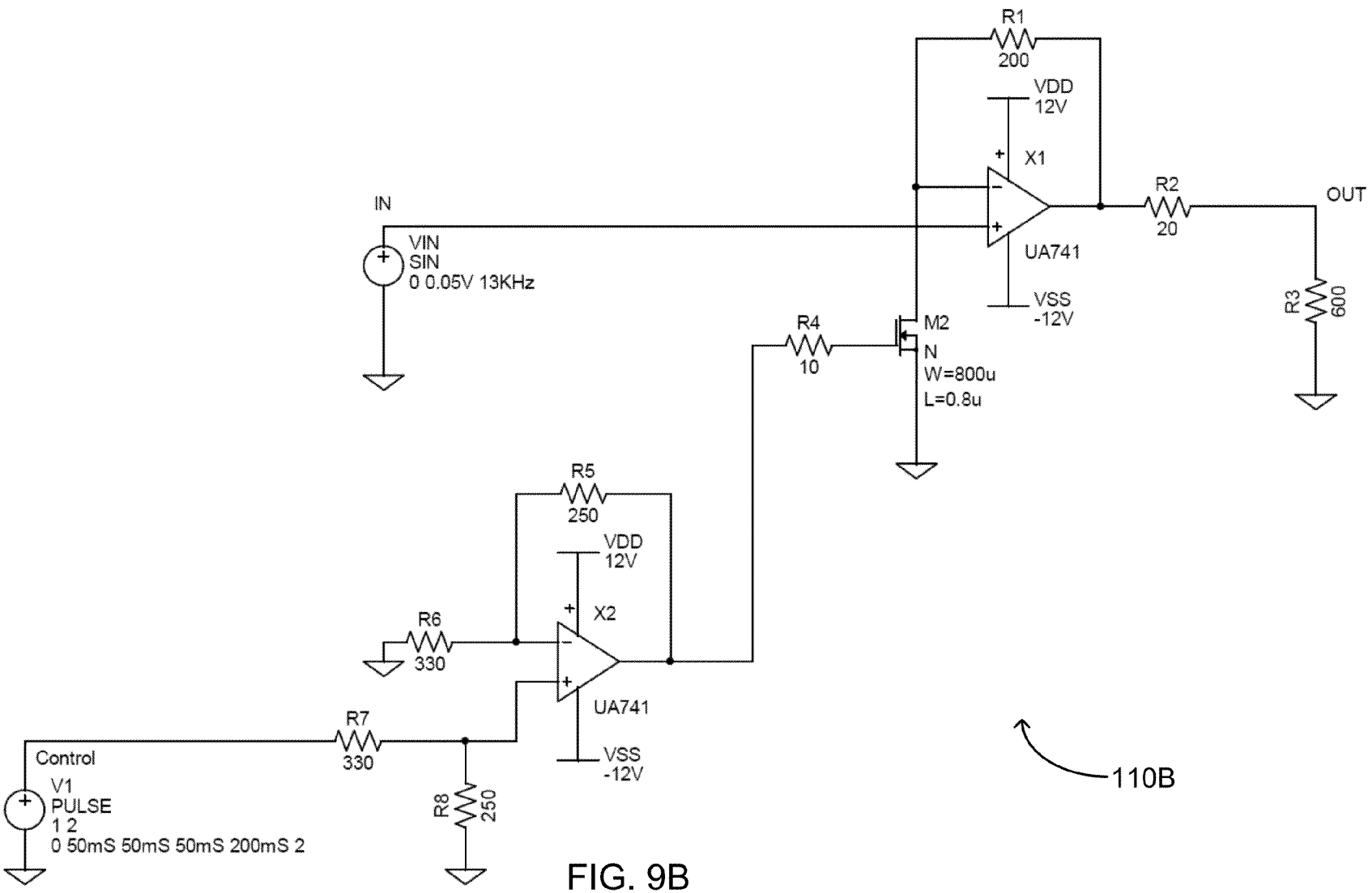
Figure 9C:
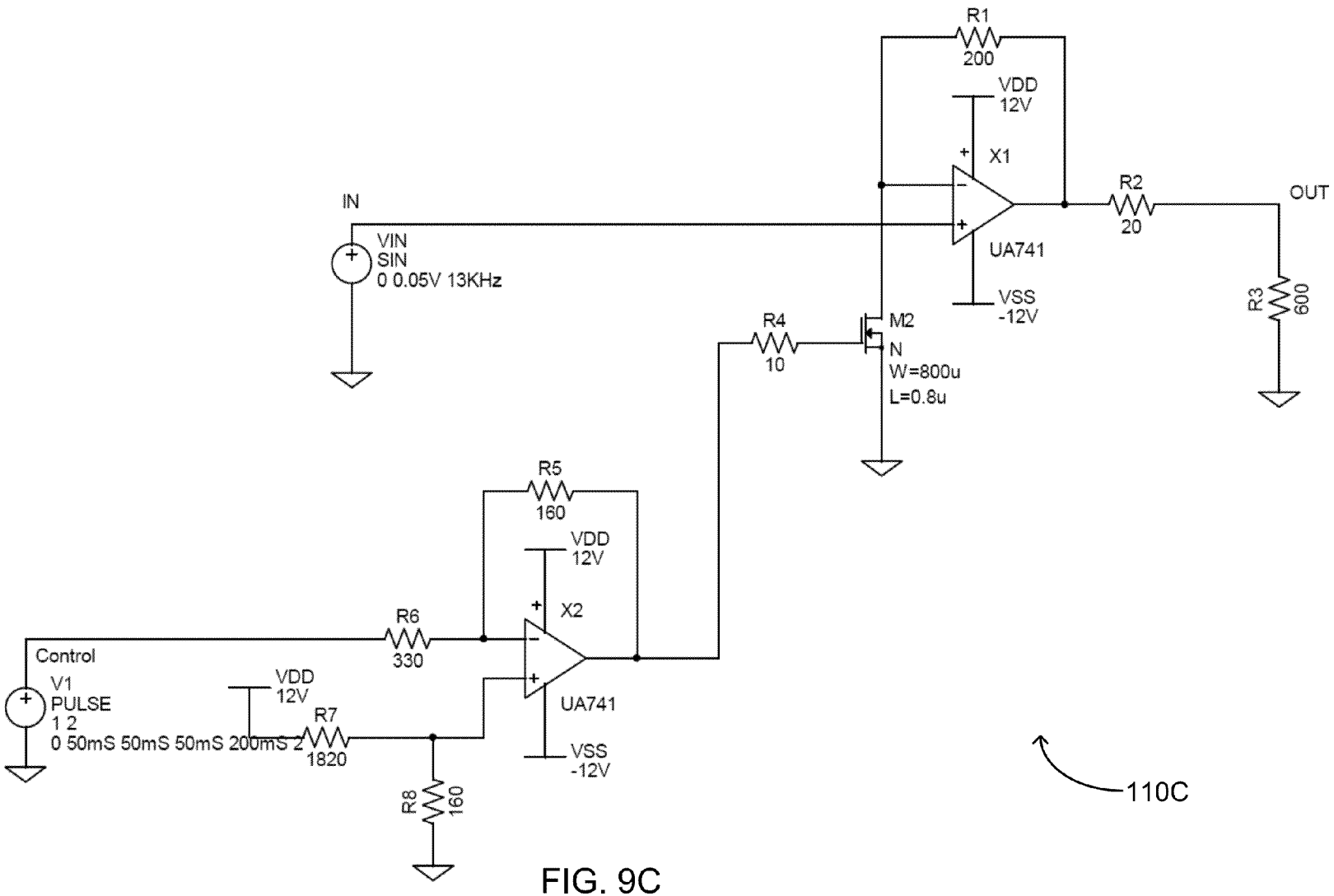
Figure 9D:
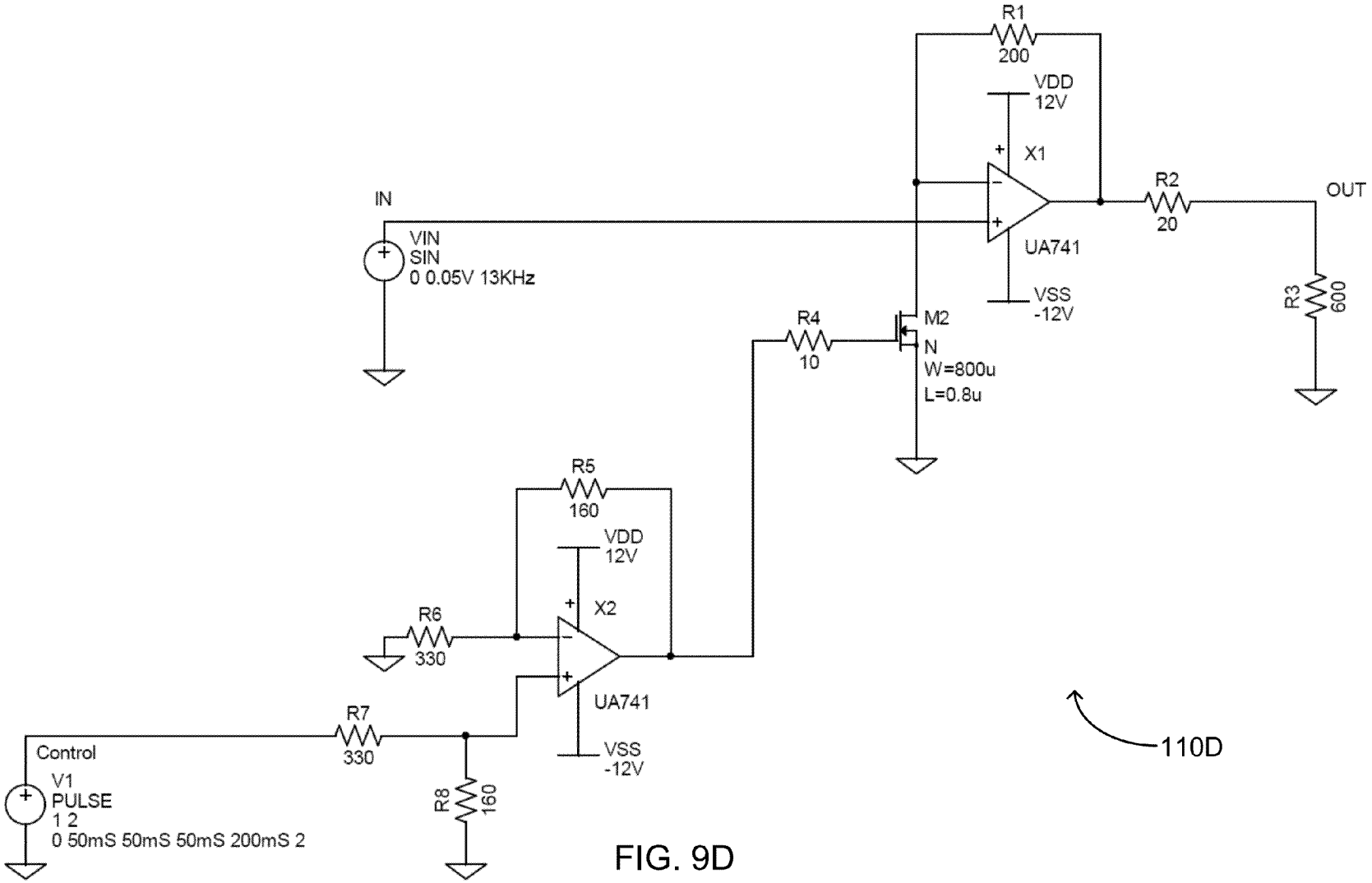
Figure 9E:
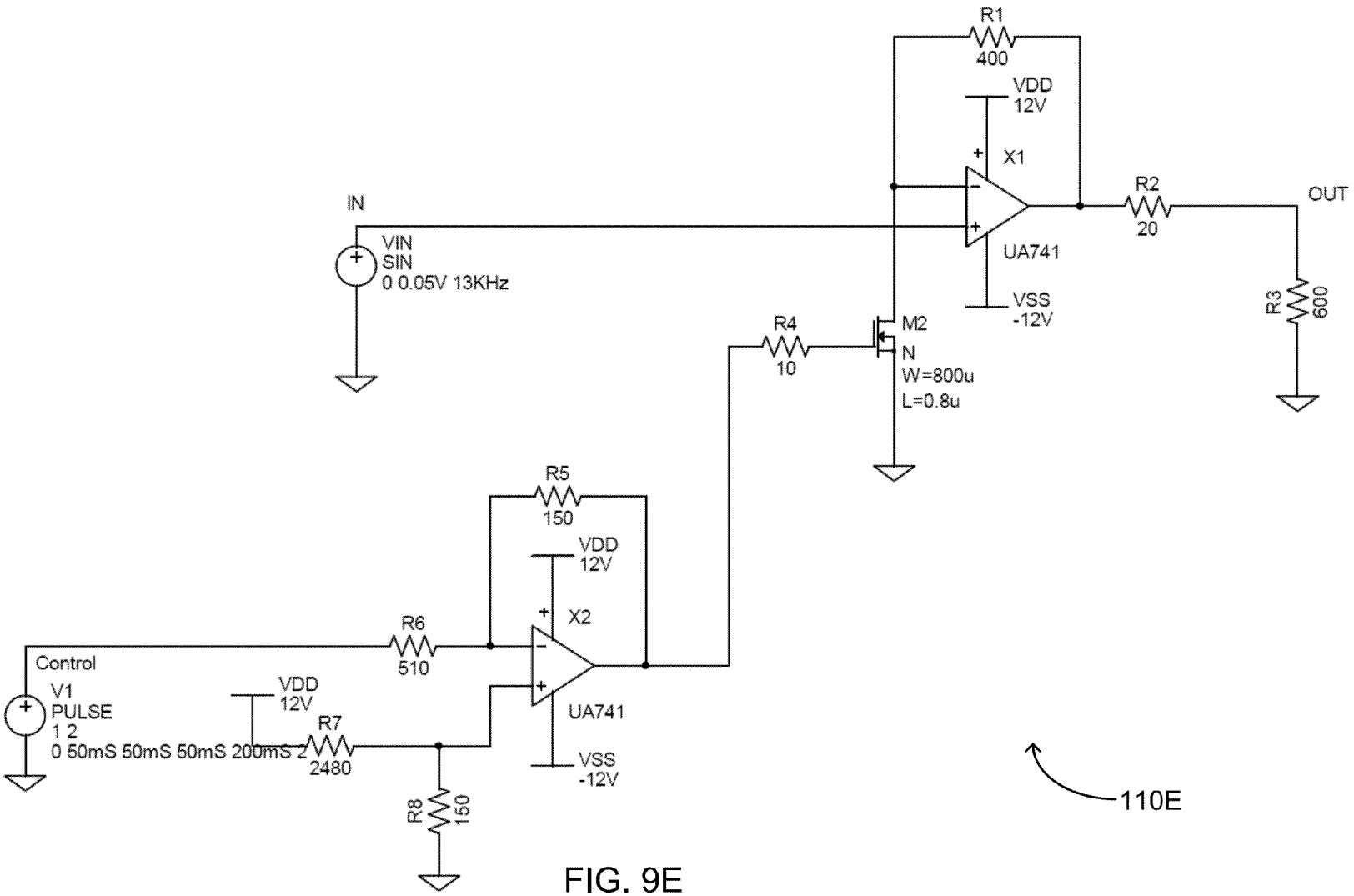
Figure 9F:
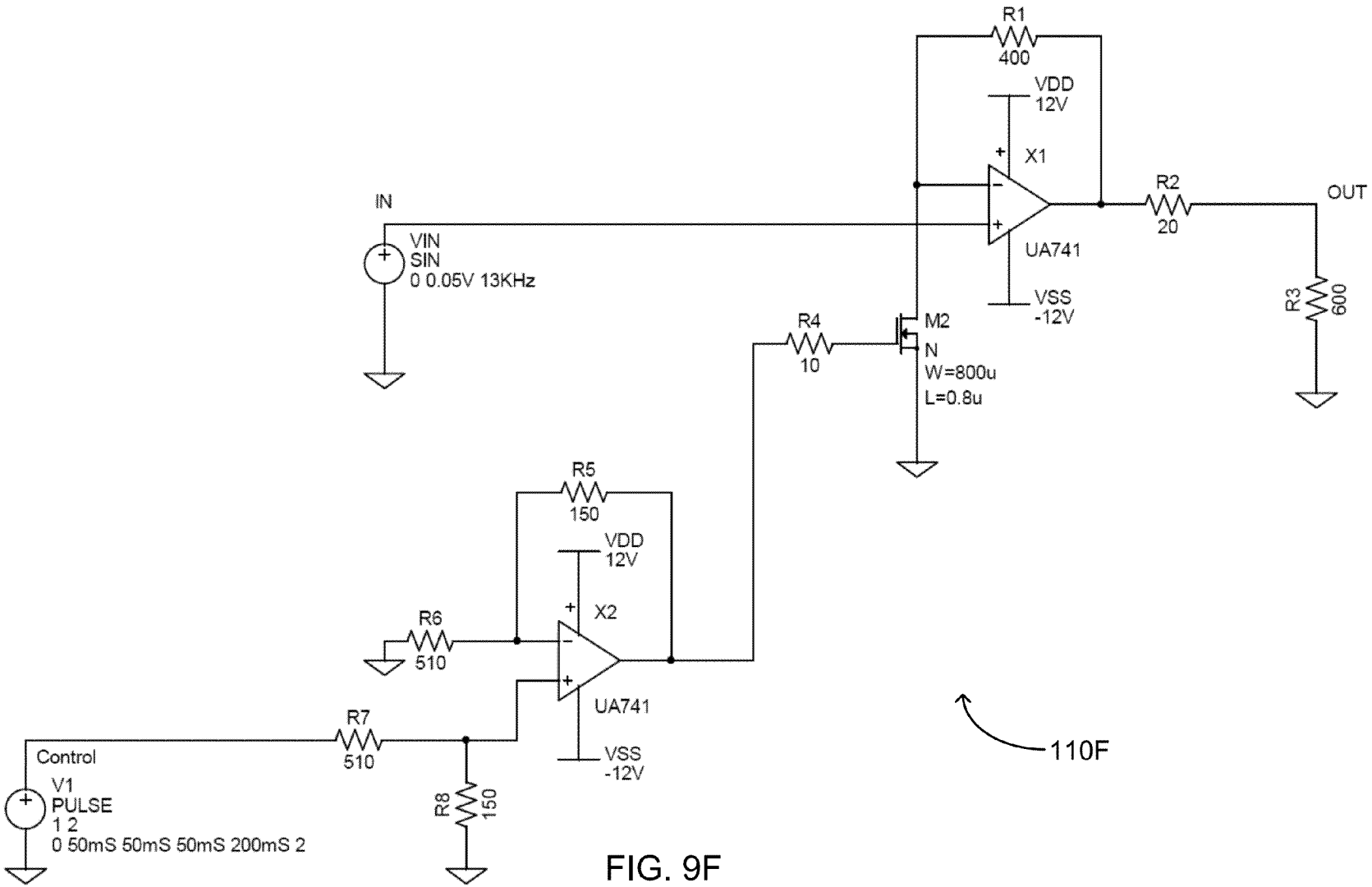

FIGS. 9A-F show example band amplification circuits 110A-F. In each of circuits 110A-F, difference signal Δ is provided at IN, and a predetermined control signal is provided at Control, to produce a desired gain for the associated band and the output at OUT. Circuit 110A of FIG. 9A provides a gain of −0.577, which translates to a "slope" of −30 degrees between difference signal Δ and the resulting output of circuit 110A. Circuit 110B of FIG. 9B provides a gain of +0.577, which translates to a "slope" of +30 degrees between difference signal Δ and the resulting output of circuit 110B. Circuit 110C of FIG. 9C provides a gain of −1, which translates to a "slope" of −45 degrees between difference signal Δ and the resulting output of circuit 110C. Circuit 110D of FIG. 9D provides a gain of +1, which translates to a "slope" of +45 degrees between difference signal Δ and the resulting output of circuit 110D. Circuit 110E of FIG. 9E provides a gain of −1.732, which translates to a "slope" of −60 degrees between difference signal Δ and the resulting output of circuit 110E. Circuit 110F of FIG. 9F provides a gain of +1.732, which translates to a "slope" of +60 degrees between difference signal Δ and the resulting output of circuit 110F.

Figure 10:
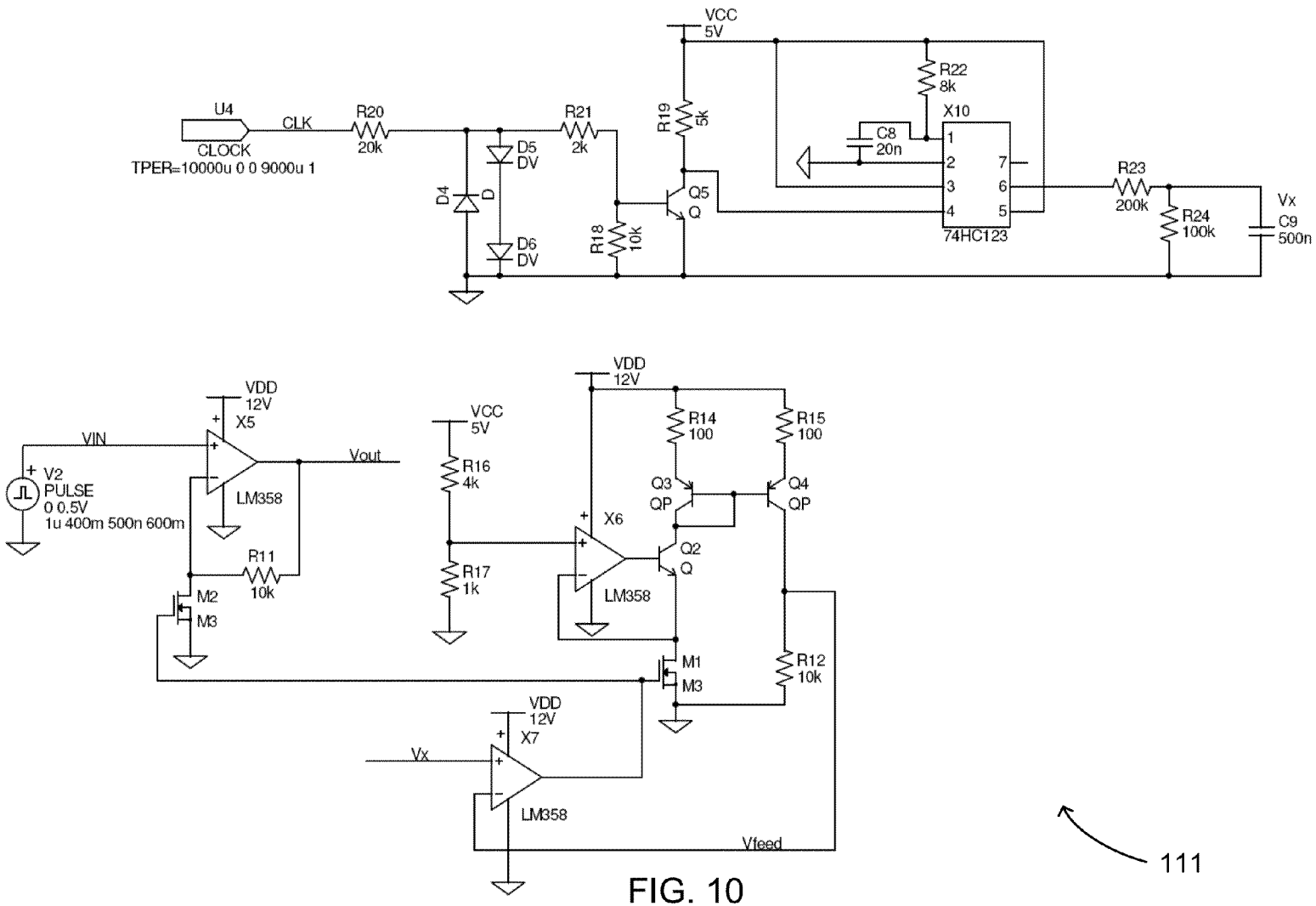
FIG. 10 schematically illustrates an example frequency to gain converter which may be incorporated into a banded amplification circuit.

FIG. 10 shows an example of a frequency to gain converter 111 which may replace op-amp X1 in any of circuits 110A-F. Frequency to gain converter 111 produces a clock signal with a frequency which gradually decreases over time. In embodiments where frequency to gain converter 111 is used in a band amplification circuit 110, the gain of that band amplification circuit 110 also gradually decreases over time. Such embodiments may be useful for situations where it would be desirable to have gain $g_n$ decrease over time for one or more bands of difference signal Δ.

Figure 11:
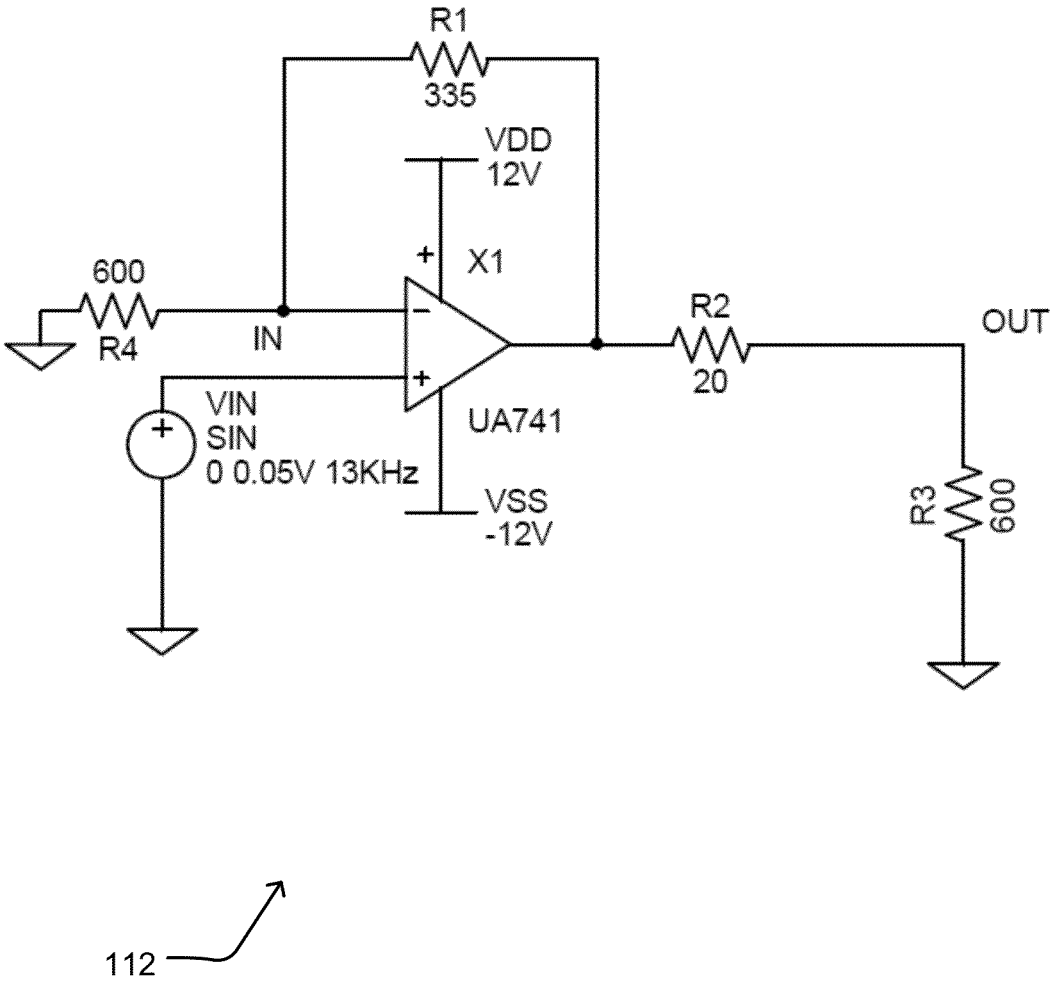
FIG. 11 schematically illustrates an example constant gain amplification circuit.

The output of each band amplification circuit 110 is provided to a constant gain circuit 112. Constant gain circuit 112 applies a gain G to the signal received from the currently active band amplification circuit 110, and provides the resulting signal to output device 20. Gain G may be selected based on the particular characteristics of output device 20. FIG. 11 shows an example constant gain circuit 112.

In some embodiments, apparatus according to the invention provides a signal amplifier having gain (or gain and offset) characteristics that change with aging in a manner that is the reverse of and cancels the changes in output of an output device with aging of the output device.

In some embodiments the output device and compensation circuit are packaged together such that they are installed and/or replaced as a unit. This ensures that aging of the output device will match aging of the compensation circuit.

Figure 12:
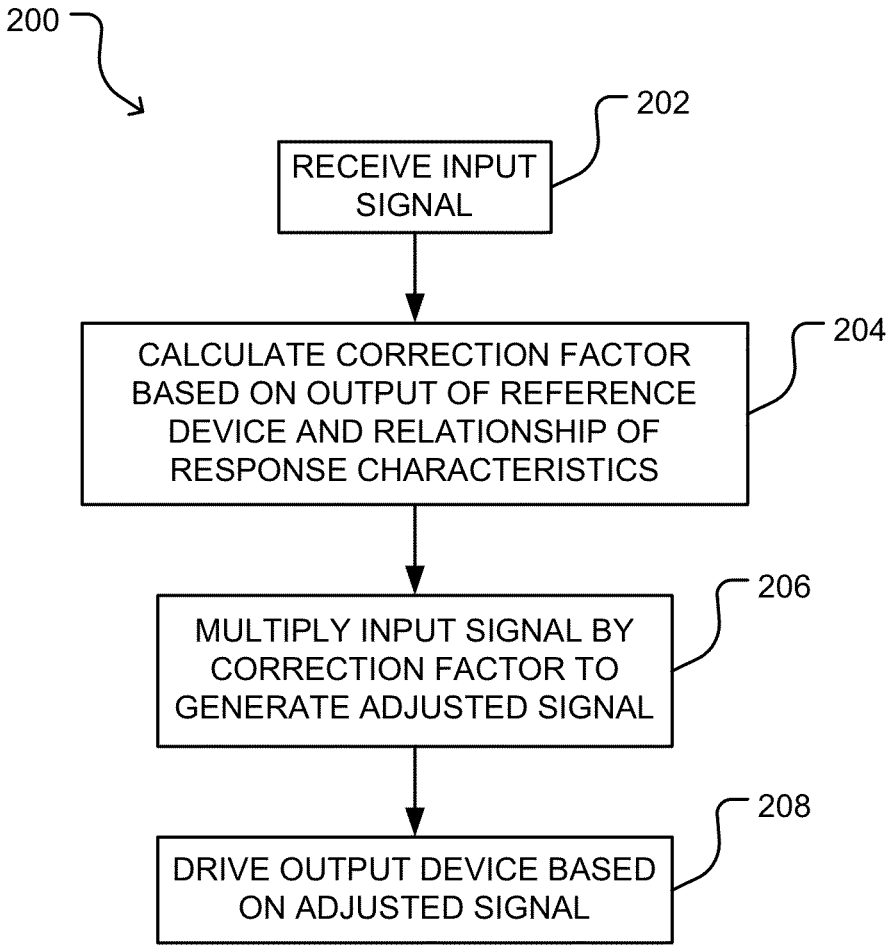
FIG. 12 is a flowchart illustrating a method of providing compensated driving signals to an output device according to one embodiment of the invention.

FIG. 12 shows a method 200 for controlling an output device having response characteristics which vary with age according to one embodiment. Method 200 may be carried out, for example, by suitable processing hardware connected to receive an input signal for the output device and an output signal from a reference device.

At block 202 an input signal for the output device is received. At block 204 a correction factor is calculated based on the output of the reference device and the relationship between the response characteristics of the output device and the response characteristics of the reference device. In some embodiments, the output of the reference device is continuously monitored and the correction factor is continuously updated. In some embodiments, the output of the reference device is monitored periodically and the correction factor is updated periodically. In some embodiments, the output of the reference device is monitored at irregular intervals and the correction factor is updated at irregular intervals.

At block 206 the input signal is multiplied by the correction factor to generate an adjusted signal. At block 208 the output device is driven based on the adjusted signal. In some embodiments the adjusted signal is applied directly to the output device. In some embodiments, the adjusted signal is provided to signal conditioning circuitry configured to further condition the adjusted signal based on output device requirements.

Certain implementations of the invention comprise computer processors which execute software instructions which cause the processors to perform a method of the invention. For example, one or more processors in a control circuit for a device may implement methods as described herein by executing software instructions in a program memory accessible to the processors. The invention may also be provided in the form of a program product. The program product may comprise any medium which carries a set of computer-readable signals comprising instructions which, when executed by a data processor, cause the data processor to execute a method of the invention. Program products according to the invention may be in any of a wide variety of forms. The program product may comprise, for example, physical media such as magnetic data storage media including floppy diskettes, hard disk drives, optical data storage media including CD ROMs, DVDs, electronic data storage media including ROMs, flash RAM, or the like. The computer-readable signals on the program product may optionally be compressed or encrypted.

Where a component (e.g. a software module, processor, assembly, device, circuit, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

As one skilled in the art will appreciate, the example embodiments discussed above are for illustrative purposes only, and methods and systems according to embodiments of the invention may be implemented in any suitable device having appropriately configured processing hardware. Such processing hardware may include one or more programmable processors, programmable logic devices, such as programmable array logic ("PALs") and programmable logic arrays ("PLAs"), digital signal processors ("DSPs"), field programmable gate arrays ("FPGAs"), application specific integrated circuits ("ASICs"), large scale integrated circuits ("LSIs"), very large scale integrated circuits ("VLSIs") or the like.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. An apparatus comprising:

a driver circuit comprising one or more components having response characteristics that vary as the one or more components age, the driver circuit configured to provide an output signal in response to a control signal;

an output device having response characteristics that vary as the output device ages;

a reference device having response characteristics that vary as the reference device ages;

a monitoring circuit connected to receive an output of the reference device and to produce a reference signal in response to the output of the reference device; and an adjustment circuit connected to receive the output signal from the driver circuit and the reference signal from the monitoring circuit;

wherein the adjustment circuit is configured to provide a driving signal for the output device, the driving signal comprising the output signal from the driver circuit adjusted based on the reference signal to compensate for aging of the output device and for aging of the one or more components in the driver circuit.

2. An apparatus according to claim 1 wherein the output device comprises a light emitting diode.

3. An apparatus according to claim 1 wherein the reference device, monitoring circuit and adjustment circuit all comprise components of an integrated circuit.

4. An apparatus according to claim 1 wherein the reference device comprises a p-n semiconductor junction, and the monitoring circuit is connected to measure a voltage drop across the reference device.

5. An apparatus according to claim 1 wherein the reference device is connected to be driven by the driving signal.

6. An apparatus according to claim 1 comprising a reference driving signal generator configured to apply a reference driving signal to the reference device when the output device is on.

7. An apparatus according to claim 1 comprising signal conditioning circuitry connected between the adjustment circuit and the output device.

8. An apparatus according to claim 1 wherein the output device and adjustment circuit are packaged together.

9. An apparatus according to claim 1 wherein the adjustment circuit comprises a variable-gain signal amplifier and the adjustment circuit is configured to set a gain of the signal amplifier based on the reference signal.

10. An apparatus according to claim 1 wherein the adjustment circuit comprises compensation logic comprising a data processor configured to implement an algorithm for computing the adjustment to the driving signal.

11. An apparatus according to claim 1 wherein the reference signal comprises a measure of a light output of the reference device, a voltage drop across the reference device, or a current in the reference device.

12. An apparatus according to claim 1 wherein the output device is characterized by a response that rises and falls with aging of the output device.

13. An apparatus according to claim 1 wherein the adjustment circuit comprises a voltage-controlled amplifier having a gain controlled by the reference signal.

14. An apparatus according to claim 1 wherein the adjustment circuit is configured to initially attenuate the driving signal applied to the output device such that a maximum output achievable by the output device remains substantially constant over an expected life span of the output device.

15. An apparatus according to claim 1 wherein the adjustment circuit comprises:

a plurality of band amplification circuits;

a switch configured to selectively connect the reference signal output by the monitoring circuit to one of the plurality of band amplification circuits;

threshold logic coupled to the output of the monitoring circuit for comparing a magnitude of the reference signal to a plurality of thresholds, the plurality of thresholds defining a plurality of bands, each band corresponding to one of the plurality of band amplification circuits; and, a control circuit coupled to the threshold logic and configured to control the switch to connect the output of the monitoring circuit to a selected band amplification circuit corresponding to the band to which the magnitude of the reference signal corresponds.

16. An apparatus according to claim 15 wherein the adjustment circuit comprises a controlled amplifier connected to receive the output signal from the driver circuit and an output from the selected band amplification circuit and configured to amplify the output signal from the driver circuit to generate the driving signal.

17. An apparatus according to claim 16 wherein the adjustment circuit comprises an attenuation circuit connected to an input of the controlled amplifier and configured to attenuate the output signal from the driver circuit before providing the attenuated signal to the controlled amplifier.

18. A method for controlling an output device in response to an input signal, the method comprising:

controlling a driver circuit based on the input signal to supply an output signal at an output of the driver circuit, the driver circuit comprising one or more components that have properties that vary as the one or more components age and operating a reference device having response characteristics which vary as the reference device ages;

monitoring an output of the reference device;

adjusting the output signal from the driver circuit according to the output of the reference device to yield a driving signal and applying the driving signal to drive an output device having response characteristics which vary as the output device ages;

wherein adjusting the output signal comprises determining an aging compensation value based on the output of the reference device, the aging compensation value indicative of an adjustment to apply to the output signal to compensate for changes in the response characteristics of the output device with aging of the output device and for changes in the response characteristics of the one or more components of the driver circuit with aging of the one or more components of the driver circuit.

19. A method according to claim 18 comprising controlling the reference device based on the input signal.

20. A method according to claim 18 comprising storing the aging compensation value in a register.

21. A method according to claim 18 wherein determining the aging compensation value comprises computing a function of the output of the reference device.

22. A method according to claim 18 wherein determining the aging compensation value comprises using the output of the reference device to access a lookup table.

* * * * *